US011189392B2

(12) United States Patent
Matsuyama et al.

(10) Patent No.: US 11,189,392 B2
(45) Date of Patent: Nov. 30, 2021

(54) X-RAY MICROSCOPE

(71) Applicant: OSAKA UNIVERSITY, Osaka (JP)

(72) Inventors: Satoshi Matsuyama, Osaka (JP); Jumpei Yamada, Osaka (JP)

(73) Assignee: OSAKA UNIVERSITY, Osaka (JP)

( * ) Notice: Subject to any disclaimer, the term of this patent is extended or adjusted under 35 U.S.C. 154(b) by 363 days.

(21) Appl. No.: 15/759,922

(22) PCT Filed: Sep. 23, 2016

(86) PCT No.: PCT/JP2016/078070
§ 371 (c)(1),
(2) Date: Mar. 14, 2018

(87) PCT Pub. No.: WO2017/051890
PCT Pub. Date: Mar. 30, 2017

(65) Prior Publication Data

US 2018/0261352 A1 Sep. 13, 2018

(30) Foreign Application Priority Data

Sep. 25, 2015 (JP) ..... JP2015-188850

(51) Int. Cl.
*G21K 7/00* (2006.01)
*G21K 1/06* (2006.01)

(52) U.S. Cl.
CPC ..... *G21K 7/00* (2013.01); *G21K 1/06* (2013.01); *G21K 1/065* (2013.01); *G21K 1/067* (2013.01); *G21K 2201/064* (2013.01)

(58) Field of Classification Search
CPC ..... G01N 2223/20; G01N 2223/04; G01N 2223/03; G01N 2223/00; G01N 23/083; G01N 23/06; G01N 23/043; G01N 23/04
See application file for complete search history.

(56) References Cited

U.S. PATENT DOCUMENTS

| | | | | |
|---|---|---|---|---|
| 5,896,438 | A | 4/1999 | Miyake et al. | |
| 2007/0121785 | A1* | 5/2007 | Dietsch | B82Y 10/00 378/84 |
| 2009/0279670 | A1* | 11/2009 | Verman | B82Y 10/00 378/145 |

FOREIGN PATENT DOCUMENTS

| | | |
|---|---|---|
| JP | 04-043998 | 2/1992 |
| JP | 08-264415 | 10/1996 |
| JP | 8-271697 | 10/1996 |
| JP | 9-145899 | 6/1997 |
| JP | 2013-221874 | 10/2013 |

(Continued)

OTHER PUBLICATIONS

Bennett "Advanced laser-backlit grazing-incidence x-ray imaging systems for inertial confinement fusion research", Optical Society of America, Applied Optics, vol. 40, No. 25, Sep. 2001, pp. 4570-4587 (Year: 2001).*

(Continued)

*Primary Examiner* — David P Porta
*Assistant Examiner* — Mamadou Faye
(74) *Attorney, Agent, or Firm* — Wenderoth, Lind & Ponack, L.L.P.

(57) ABSTRACT

An X-ray microscope includes at least one of an X-ray source, a sample holding part, a concave Kirkpatrick-Baez mirror, a convex Kirkpatrick-Baez mirror, and a light receiving part located at a position in an imaging relation to a position of the sample holding part in this order along an optical axis.

13 Claims, 13 Drawing Sheets

(56) References Cited

FOREIGN PATENT DOCUMENTS

| | | | |
|---|---|---|---|
| JP | 2014-13169 | | 1/2014 |
| JP | 2014013169 A | * | 1/2014 |

OTHER PUBLICATIONS

Hoover et al. "Design of An Imaging Microscope for Soft X-Ray Applications" SPIE vol. 984 (1988) pp. 234-246. (Year: 1988).*
Translation of Satoshi et al. (JP-2014013169A; pub. Jan. 23, 2014) (Year: 2014).*
Translate of JP 2014013169 (Year: 2014).*
NPL search (Year: 2021).*
International Search Report dated Dec. 6, 2016 in International (PCT) Application No. PCT/JP2016/078070.
Matsuyama et al., "Achromatic and high-resolution full-field X-ray microscopy based on total-reflection mirrors", Optics Express, vol. 23, No. 8, Apr. 20, 2015, pp. 9746-9752.
Extended European Search Report dated May 24, 2019 in corresponding European Patent Application No. 16848678.5.
Office Action dated Apr. 26, 2019 in corresponding Korean Patent Application No. 10-2018-7007977 with English translation.
Office Action dated Feb. 21, 2020 in European Patent Application No. 16 848 678.5.
Office Action dated Mar. 26, 2020 in Chinese Patent Application No. 201680054724.1, with English translation.
Office Action dated Nov. 11, 2020 in Chinese Patent Application No. 201680054724.1, with English Translation.
Office Action dated May 7, 2021 in European Patent Application No. 16848678.5.

* cited by examiner

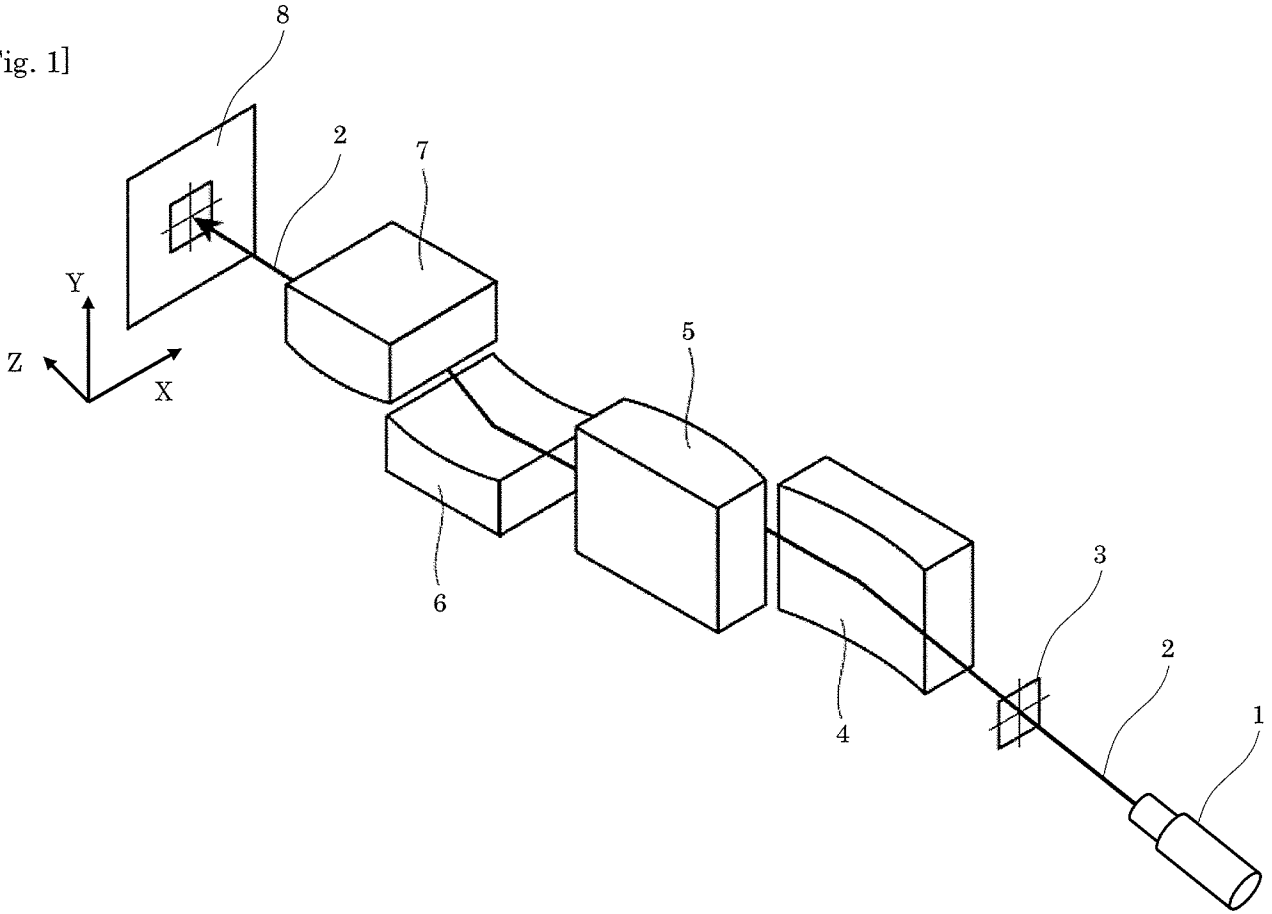
[Fig. 1]

[Fig. 2]
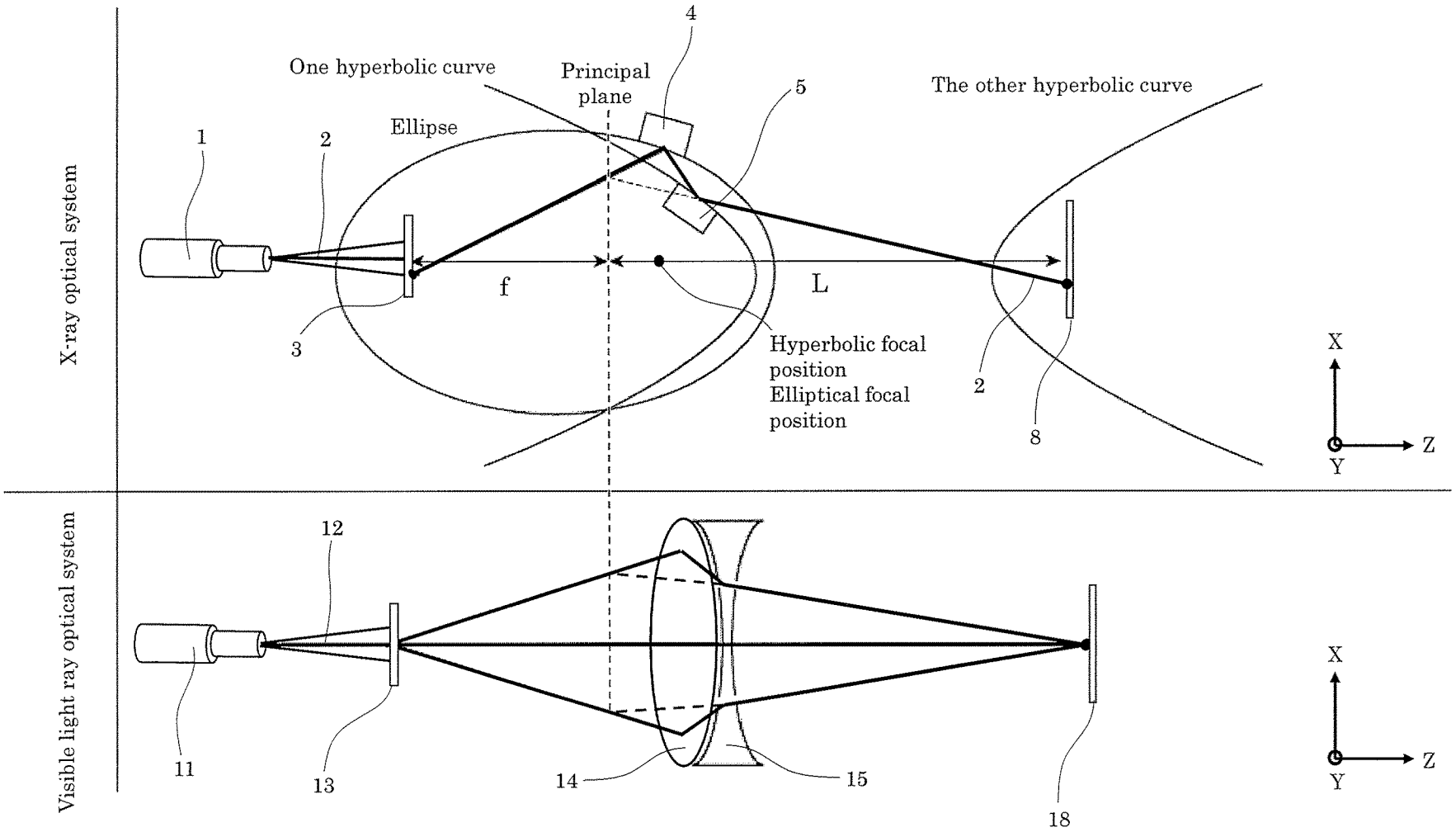

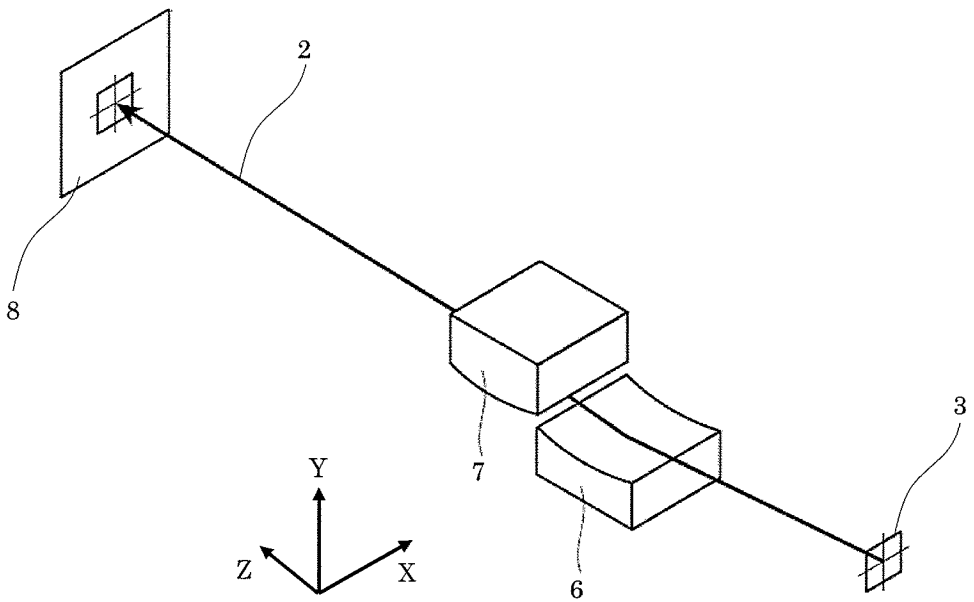
[Fig. 3]

[Fig. 4]
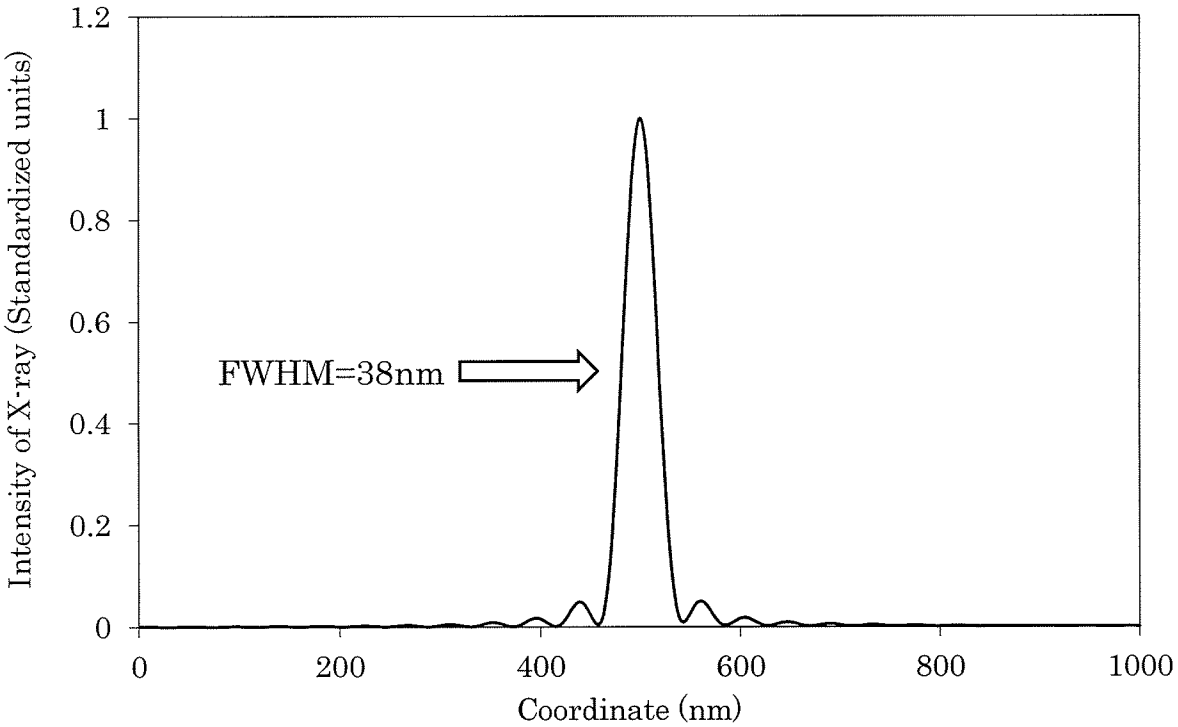

[Fig. 5]
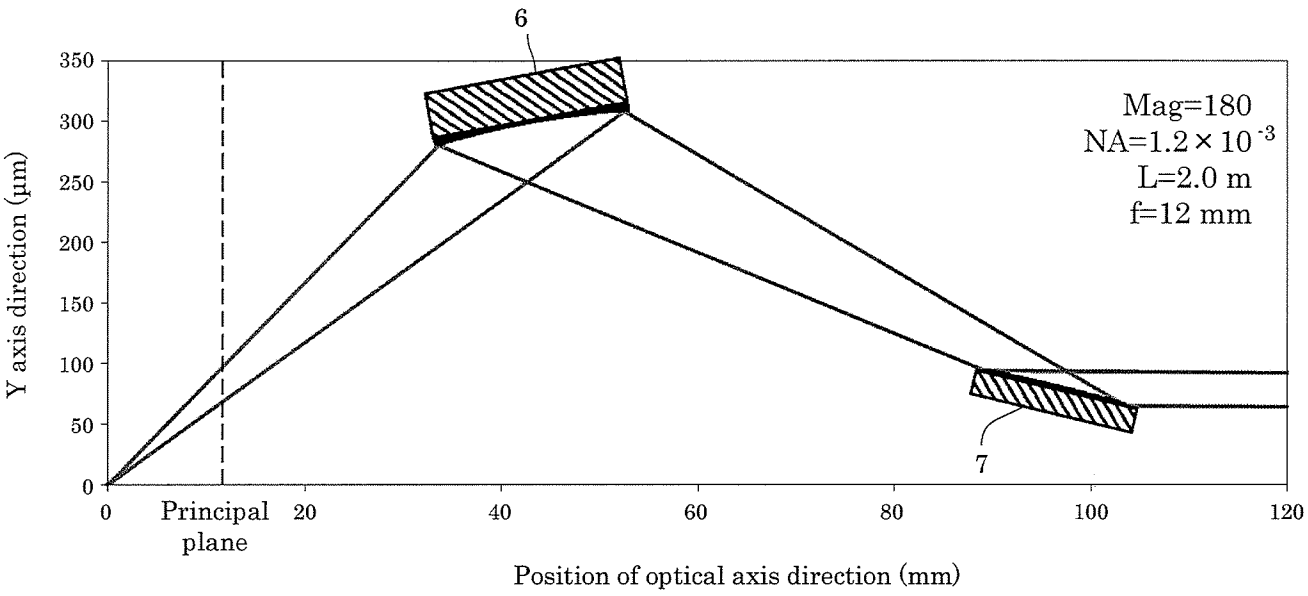

[Fig. 6]
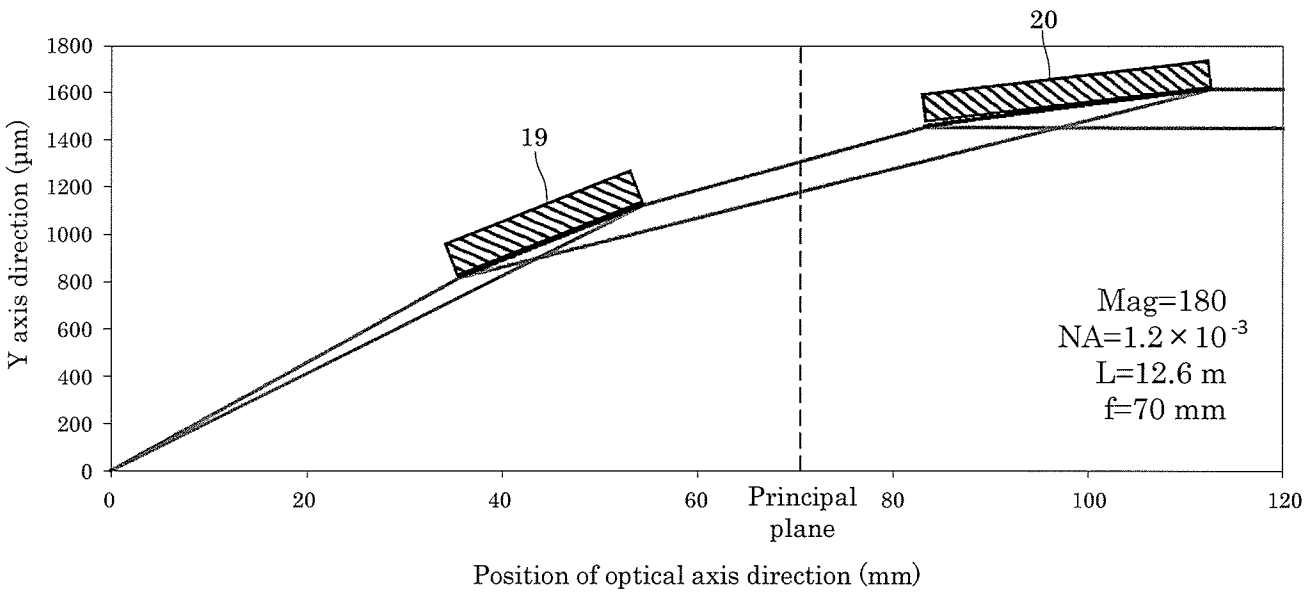

[Fig. 7]
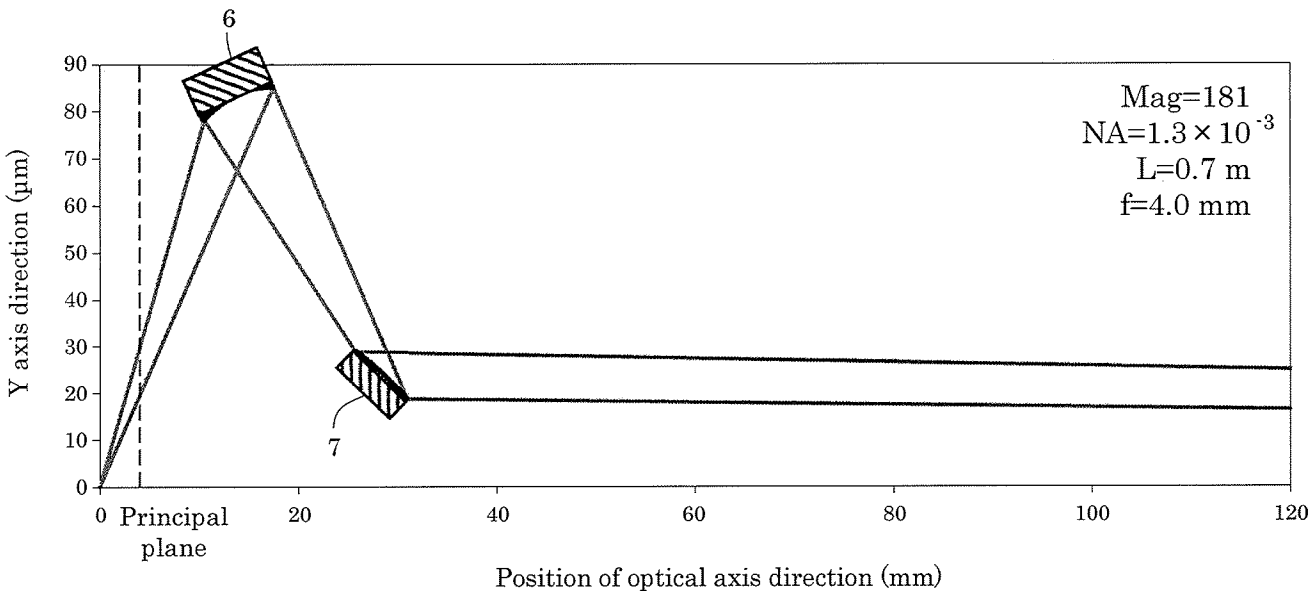

[Fig. 8]
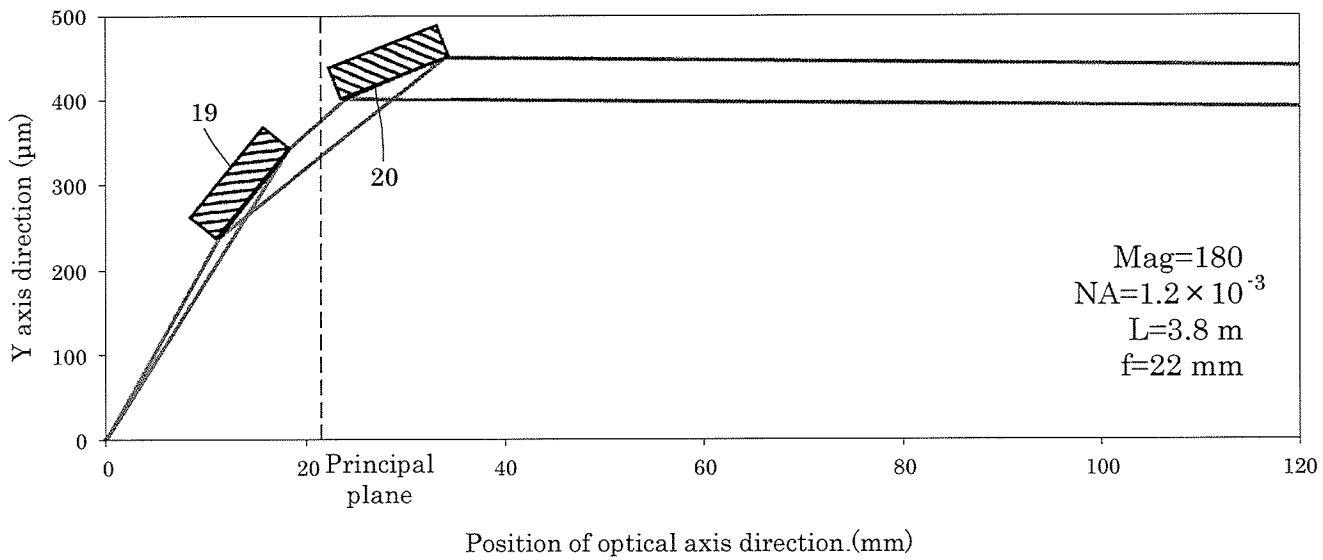

[Fig. 9]
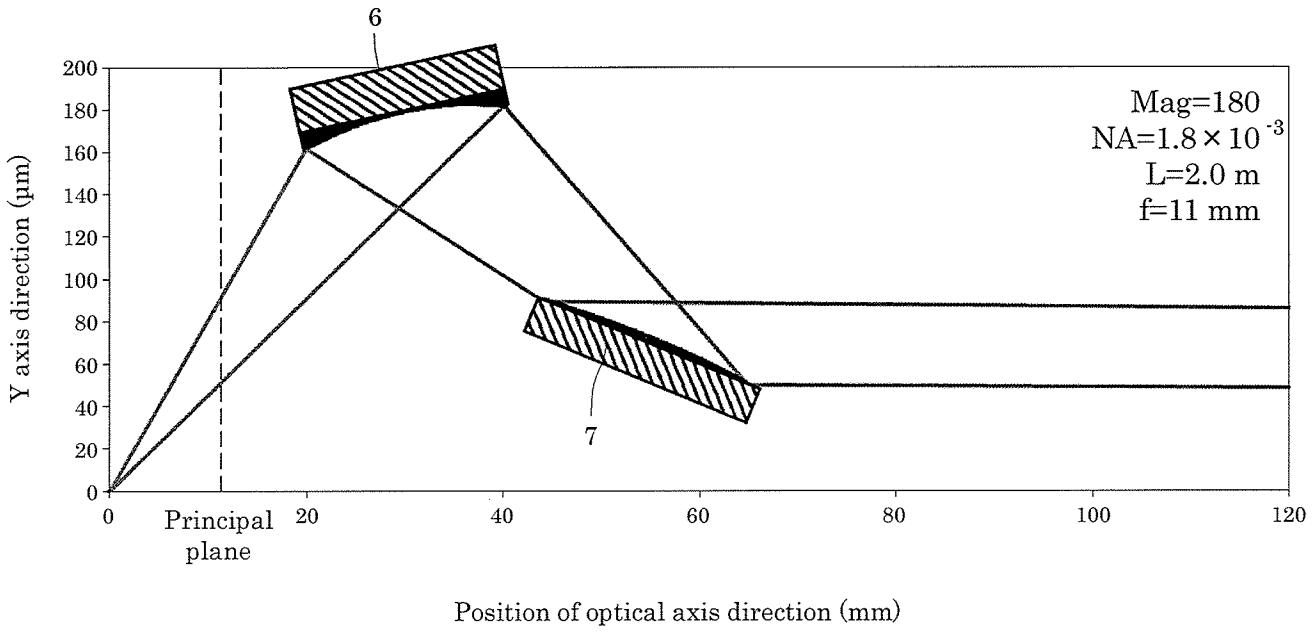

[Fig. 10]
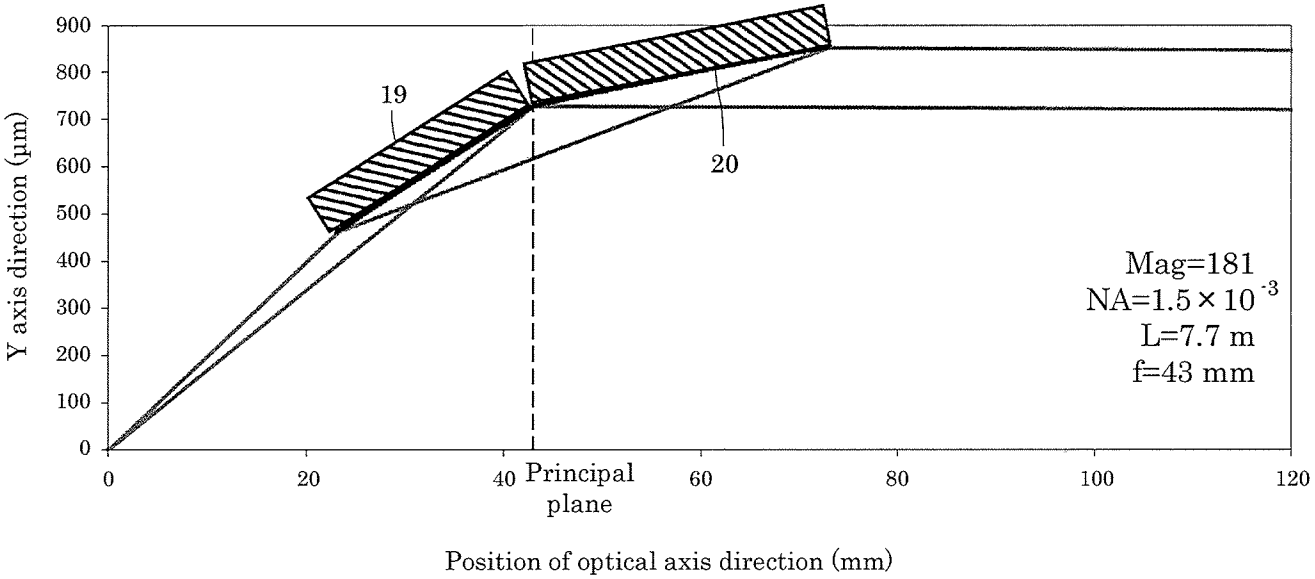

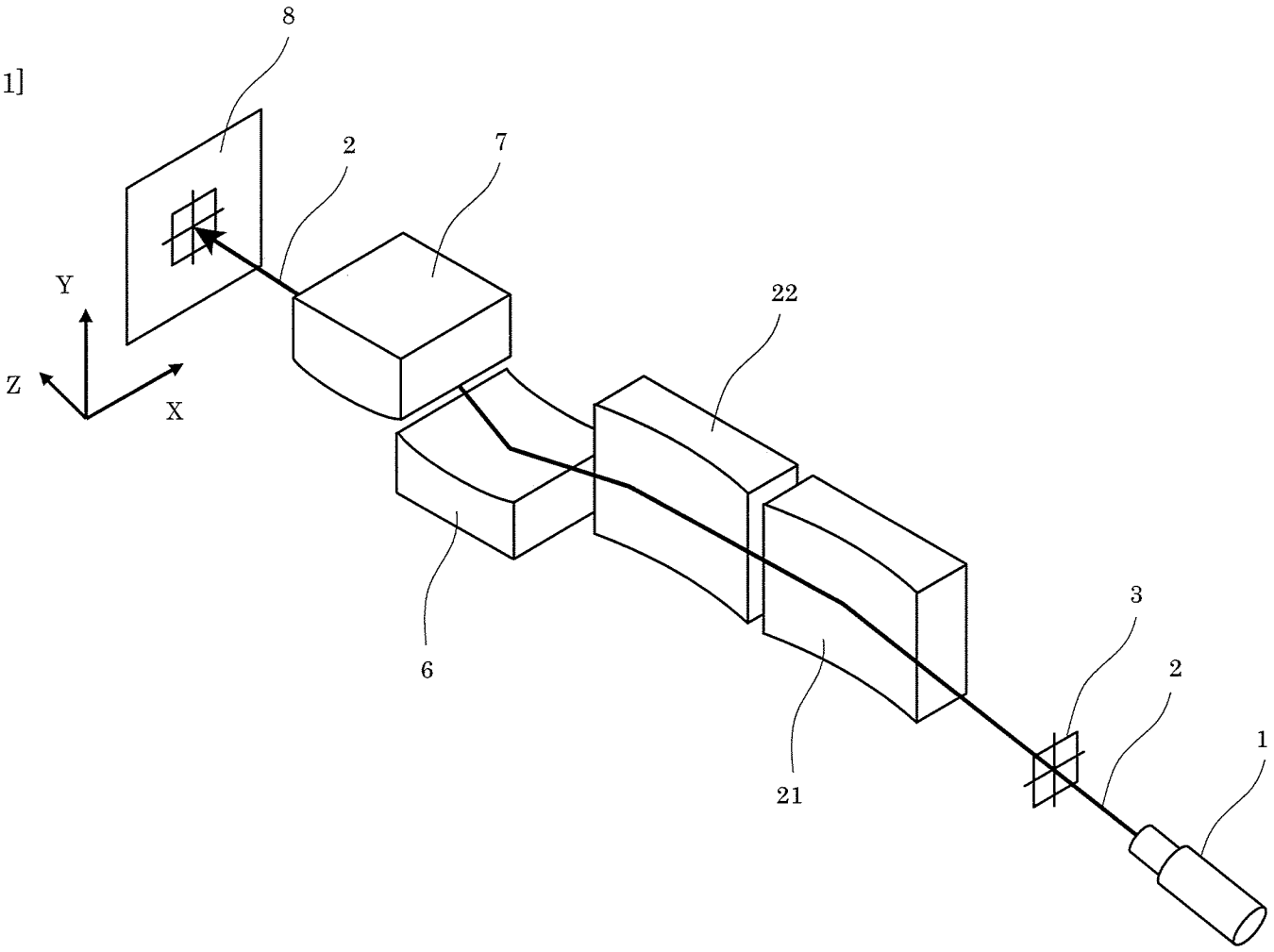
[Fig. 11]

[Fig. 12]
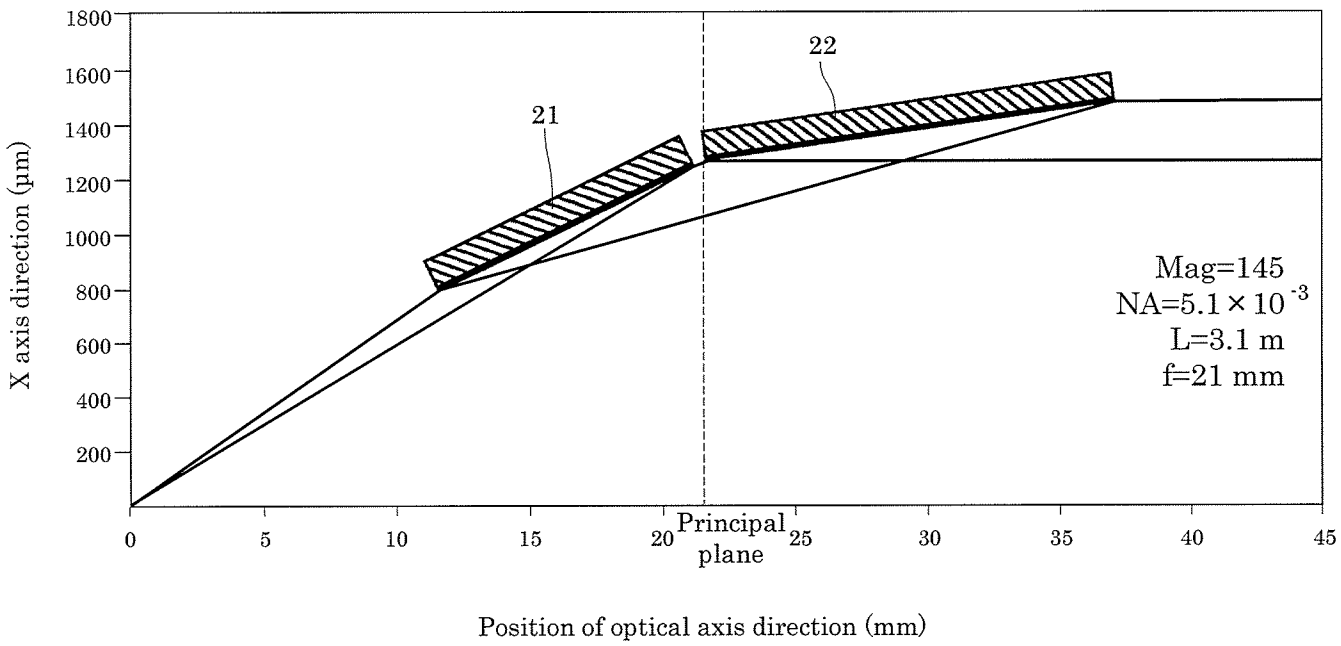

[Fig. 13]
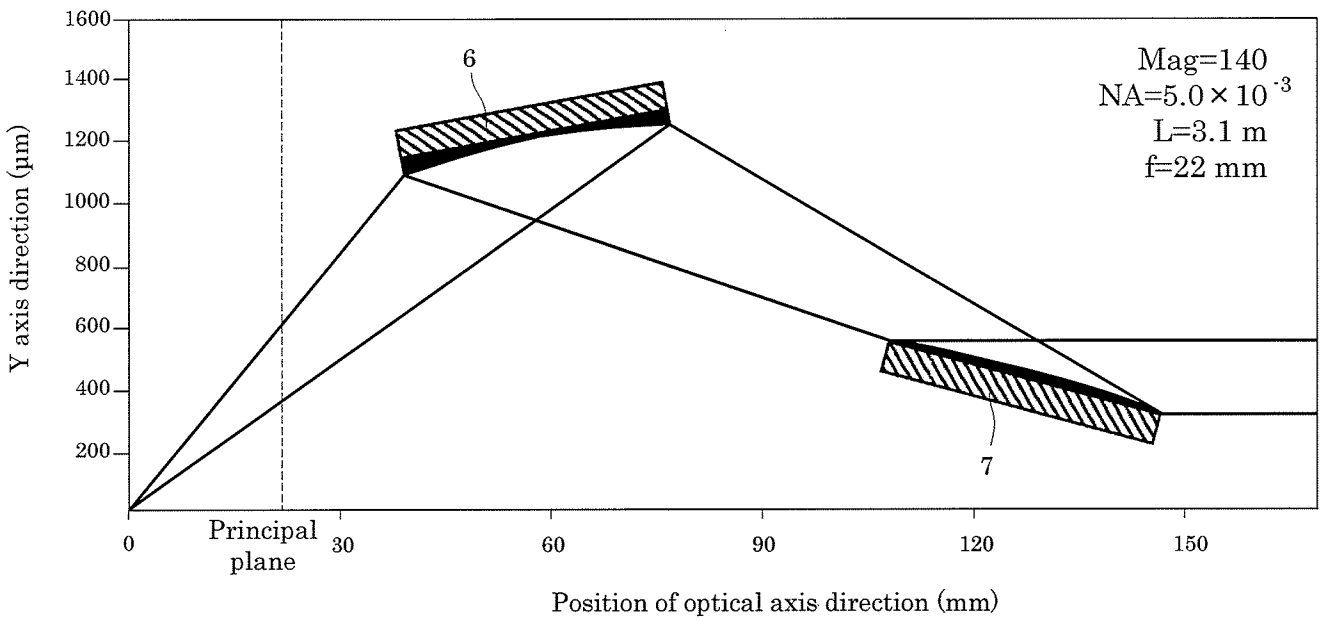

X-RAY MICROSCOPE

CROSS-REFERENCE TO RELATED APPLICATION

This application claims the benefit of the priority date of Japanese Patent Application No. 2015-188850 filed on Sep. 25, 2015. All of the contents of Japanese Patent Application No. 2015-188850 filed on Sep. 25, 2015 are incorporated by reference herein.

TECHNICAL FIELD

The present invention relates to an X-ray microscope, and particularly relates to an X-ray microscope using a Kirkpatrick-Baez mirror.

BACKGROUND ART

An X-ray microscope is an imaging optical system using electromagnetic wave having an extremely short wavelength, and has, in principle, a sub-nm high resolution significantly higher than that of an optical microscope. The high transmission power of an X-ray allows observation of a three-dimensional tomographic image of a thick sample, which is difficult with a transmissive electron microscope. In addition, basically, the X-ray microscope does not need vacuum formation, and thus, is suitable for observation in an environment (for example, an atmosphere of water solution and gas) in which in-situ measurement is required. In addition, not only electron density distribution but also a local coupling state and element distribution can be acquired by combining X-ray analysis technologies such as fluorescence X-ray analysis and X-ray absorption spectroscopy. The X-ray microscope, which has such various advantages, is expected to be used in various scientific fields.

Examples of promised candidates for an imaging element in the X-ray microscope include a Fresnel zone plate, an X-ray refraction lens, a Kirkpatrick-Baez (KB) mirror, and a Wolter mirror. The Fresnel zone plate and the X-ray refraction lens can be sufficiently accurately manufactured to achieve a sub-50-nm resolution. However, the Fresnel zone plate and the refraction lens are not suitable for multicolor imaging because of chromatic aberration occurring due to diffraction. The KB mirror employs total reflection and thus does not suffer chromatic aberration. However, it is difficult to satisfy the Abbe sine condition with single reflection in an grazing-incidence optical system such as the KB mirror, and accordingly, coma occurs, which leads to decrease of the resolution and the field of view (FOV). The Wolter mirror, which solves chromatic aberration and coma, is an excellent X-ray imaging system.

However, even when the state-of-the-art ultraprecise fabrication technology is used, it is difficult to fabricate the Wolter mirror at a shaping accuracy (order of 1 nm) necessary for achieving a resolution at diffraction limit because the Wolter mirror has a mirror surface formed of an ellipsoid surface and a hyperboloid surface disposed on a tubular inner surface. Thus, wavefront aberration in the Wolter mirror due to shaping error is a serious problem that currently cannot be avoided, and there has been no report so far that the mirror is produced at a shaping accuracy sufficient to achieve high resolution performance (100 nm or less).

Examples of an X-ray optical system using the KB mirror include an optical system (Advanced KB mirror) using four grazing-incidence total reflection X-ray mirrors of a horizontal elliptical mirror, a vertical elliptical mirror, a horizontal hyperbolic mirror, and a vertical hyperbolic mirror as disclosed in JP-A-2013-221874. In this optical system, a horizontal stage and a vertical stage are disposed along the optical axis direction of an X-ray, the horizontal elliptical mirror and the horizontal hyperbolic mirror are provided on the horizontal stage in a finely adjustable manner, and the vertical elliptical mirror and the vertical hyperbolic mirror are provided on the vertical stage in a finely adjustable manner. The optical system includes a mirror manipulator that sets a front-rear positional relation between the horizontal elliptical mirror and the horizontal hyperbolic mirror and a front-rear positional relation between the vertical elliptical mirror and the vertical hyperbolic mirror to be the same in the optical axis direction, and an off-line alignment monitoring means that provides a reference for fine adjustment so that the horizontal postures of the horizontal elliptical mirror and the horizontal hyperbolic mirror and the vertical postures of the vertical elliptical mirror and the vertical hyperbolic mirror are ideal within the margin of error.

The X-ray optical system disclosed in JP-A-2013-221874 achieves scaling up and down of an X-ray of 2 keV or higher at a high resolution of 200 nm or less without aberration.

SUMMARY OF THE INVENTION

Problems to be Solved by the Invention

However, a Kirkpatrick-Baez (KB) mirror type X-ray microscope allows various kinds of improvement. Unless a problem that cannot be ignored when it is assumed that the X-ray microscope is widely spread and used in various scientific fields is solved, in other words, unless the length of an X-ray microscope device is within two to three meters, it is needed to prepare a facility, for example, a corridor width and an entrance width of which are specially designed to be large to convey the X-ray microscope. When the X-ray microscope is larger than this size, wide use in existing research facilities or the like is hampered for the X-ray microscope even with excellent performance such as a resolution. The present invention is intended to provide an X-ray microscope that has a size small enough to be brought into a room and can be widely used.

Solution to Problem

An X-ray microscope according to the present invention which solves the above problem comprises an X-ray source, a sample holding part, a Kirkpatrick-Baez mirror having a reflection concave surface (that is hereinafter referred to as a "concave KB mirror"), a Kirkpatrick-Baez mirror having a reflection convex surface (that is hereinafter referred to as a "convex KB mirror"), and a light receiving part located at a position in an imaging relation to a position of the sample holding part in this order.

Although described later in detail, in the X-ray microscope according to the present invention, the concave KB mirror is disposed on a side closer to the sample holding part, and the convex KB mirror is disposed on a side closer to the light receiving part. Thus, the distance (front-side focal distance) between the position of the principal plane of a lens system and the sample holding part can be reduced as compared to conventional cases. Accordingly, it is possible to achieve an X-ray microscope in which the rear-side focal distance as the distance between the position of the principal plane of the lens system and the light receiving part can be significantly shortened when it is assumed that the magnification is approximately same as that of a conventional optical system, and that has a length of two to three meters or less.

In the X-ray microscope, it is preferred that the reflection concave surface of the concave KB mirror includes an elliptical curve, and the sample holding part is located at a focal position of the ellipse.

In the X-ray microscope, it is preferred that the reflection convex surface of the convex KB mirror includes one curved line of a hyperbolic curve that is composed of the one curved line and the other curved line, and the light receiving part is located at a focal position of the other curved line side of focal positions of the hyperbolic curve.

In the X-ray microscope, it is preferred that a distance between the concave KB mirror and the light receiving part is longer than a distance between the convex KB mirror and the light receiving part.

In the X-ray microscope, it is preferred that a principal plane of an imaging system including the convex KB mirror and the concave KB mirror is located between the sample holding part and the concave KB mirror.

In the X-ray microscope, it is preferred that a distance between the position of the sample holding part and the position of the light receiving part is 2.5 m or less.

In the X-ray microscope, it is preferred that at least the two convex KB mirrors and at least the two concave KB mirrors are provided, a normal of one of the convex KB mirrors and a normal of the other of the convex KB mirrors are non-parallel to each other, and a normal of one of the concave KB mirrors and a normal of the other of the concave KB mirrors are non-parallel to each other.

In the X-ray microscope, it is preferred that a shortest distance between the sample holding part and the concave KB mirror is 6 mm or more.

In the X-ray microscope, it is preferred that at least one of the convex KB mirror and the concave KB mirror is installed so as to be movable in an optical axis direction.

In the X-ray microscope, it is preferred that a first concave KB mirror and a second concave KB mirror are provided between the sample holding part and the concave KB mirror, a normal of the concave KB mirror and a normal of the first concave KB mirror are non-parallel to each other, and a normal of the convex KB mirror and a normal of the second concave KB mirror are non-parallel to each other.

In the X-ray microscope, it is preferred that the first concave KB mirror is located closer to the sample holding part than the second concave KB mirror, a reflection concave surface of the first concave KB mirror includes a hyperbolic curve, and a reflection concave surface of the second concave KB mirror includes an elliptical curve.

Advantageous Effects of Invention

An X-ray microscope according to the present invention includes an X-ray source, a sample holding part, a concave KB mirror, a convex KB mirror, and a light receiving part located at a position in an imaging relation to the position of the sample holding part in this order along an optical axis, and thus can have a reduced rear-side focal distance of an optical system while the magnification is maintained. Accordingly, a conventional X-ray microscope can be made to have a size that can be brought into a room, in other words, a widely usable size, thereby achieving high industrial applicability due to increased use of X-ray microscopes in various scientific fields.

BRIEF DESCRIPTION OF THE DRAWINGS

FIG. 1 is a perspective view of an optical system of an X-ray microscope in Embodiment 1 of the present invention.

FIG. 2 illustrates a geometric pattern diagram (upper part) of an X-ray optical system illustrated in FIG. 1, and illustrates, for reference, a visible light ray optical system (lower part) having a geometric optical function equivalent to an optical element used in the X-ray optical system.

FIG. 3 is a perspective view of the optical system of the X-ray microscope in Embodiment 2 of the present invention.

FIG. 4 illustrates a point spread function by the X-ray microscope in Embodiment 2.

FIG. 5 illustrates an X-ray optical path of the X-ray microscope in Embodiment 3.

FIG. 6 illustrates an X-ray optical path of the X-ray microscope in Comparative Embodiment 1.

FIG. 7 illustrates an X-ray optical path of the X-ray microscope in Embodiment 4.

FIG. 8 illustrates an X-ray optical path of the X-ray microscope in Comparative Embodiment 2.

FIG. 9 illustrates an X-ray optical path of the X-ray microscope in Embodiment 5.

FIG. 10 illustrates an X-ray optical path of the X-ray microscope in Comparative Embodiment 3.

FIG. 11 is a perspective view of the optical system of the X-ray microscope in Embodiment 6 of the present invention.

FIG. 12 illustrates an X-ray optical path (X-axis projection) of the X-ray microscope in Embodiment 6.

FIG. 13 illustrates an X-ray optical path (Y-axis projection) of the X-ray microscope in Embodiment 6.

DESCRIPTION OF THE EMBODIMENTS

An X-ray microscope in an embodiment of the present invention will be described below. An X-ray microscope according to the present invention includes at least one of each of an X-ray source, a sample holding part, a concave KB mirror, a convex KB mirror, and a light receiving part located at a position in an imaging relation to the position of the sample holding part in this order along an optical axis. With this configuration, the rear-side focal distance of an optical system can be reduced while the magnification of the X-ray microscope is held. The following sequentially describes the X-ray source, the sample holding part, the concave KB mirror, the convex KB mirror, and the light receiving part, which are basic requirements of the present Invention.

1. X-Ray Source

Any device having a function to emit an X-ray is applicable, but a small X-ray tube for laboratory usage is preferably used, and alternatively, a synchrotron radiation facility (such as SPring-8) can be used. Similarly to a normal optical microscope using a visible light ray, the X-ray microscope preferably uses Kohler illumination or critical illumination, and it is desirable to use a light source capable of achieving these illuminations. It is difficult to perform complicated Kohler illumination in an X-ray region, and thus, typically, critical illumination is performed, or an X-ray approximately having the range of the field of view is emitted as appropriate. Accordingly, a sample as an observation target can be irradiated with an X-ray having uniform intensity, and clear imaging with little blurring can be obtained. The energy of an X-ray is not particularly limited, and a soft X-ray, an X-ray, and a hard X-ray can be used, but it is desirable to use an X-ray or a hard X-ray having energy of 2 keV or higher to obtain a high resolution of 200 nm or less.

2. Sample Holding Part

The sample holding part may be any instrument having a function to hold a sample as an observation target on the optical path of an X-ray. The sample holding part may be, for example, a table on which a sample is simply placed, two dielectric flat plates for sandwiching a sample therebetween, a dielectric single-plate for fixing a sample, a frame for hanging a sample, or a container for holding a liquid sample. An instrument having any configuration having a function to hold a sample on the optical path of an X-ray may be used as the sample holding part. The material of the sample holding part is not particularly limited, but it is desirable to use a material that transmits an X-ray when the X-ray is directly incident on the sample holding part. It is also desirable to select a material to which accumulation of electric charge due to X-ray irradiation is unlikely to occur.

3. KB Mirror

The reflection surface of the above-described Wolter mirror is formed by a rotational locus of a curved line, but, a KB mirror used in the present invention is a one-dimensional condensing mirror having curvature only in one direction. The KB mirror has a shape close to a flat plate, and thus it is easier to fabricate a surface thereof as compared to the Wolter mirror. The incident angle (angle between the surface of the KB mirror and the optical axis) of an X-ray by the KB mirror is typically several milliradian approximately, and 80 to 90% approximately of an incident X-ray is reflected. When the incident angle is large, a larger fraction of the X-ray transmits the KB mirror.

It is sufficient that a part of the entire of one KB mirror where the reflection surface is formed in a curved surface extends across a range irradiated with an X-ray. However, it is preferable to form a mirror shape continuously for a long interval in the other direction orthogonal to the one direction in which the KB mirror has the curvature so that a surface not irradiated with an X-ray can be used by sliding the KB mirror when the irradiated part degrades while the KB mirror is used. For example, the length of the mirror formation interval in the other direction is preferably two to five times, more preferably two to ten times, further preferably two to fifteen times larger than the length of a mirror formation interval in the one direction.

The accuracy of the shape (JIS B0182 Basics 306) of the reflection surface of the KB mirror is preferably 5 nm or less, more preferably 3 nm or less, further preferably 1 nm or less. The surface roughness (JIS B0091: Rms) of the reflection surface is preferably 0.5 nm or less, more preferably 0.3 nm or less, further preferably 0.1 nm or less.

Typically, the term "KB mirror" indicates a pair of mirrors, the directions (for example, X and Y directions) of the normals of which are orthogonal to each other. However, a "KB mirror" used herein indicates a single (one) X-ray mirror. Thus, the X-ray microscope according to the present invention includes a case in which a single mirror is used, and also includes a case in which a plurality of mirrors, the directions of the normals of which are different from one another are included. In the case in which a plurality of mirrors, the directions of the normals of which are different from each other are included, the normals are desirably angled from each other at a value by dividing 360° by "the number of mirrors"×2. For example, when imaging is achieved by using two KB mirrors, the normals of the mirrors are preferably angled at 360°/(2×2)=90° from each other.

The X-ray microscope according to the present invention is applicable to a case in which only one pair of one convex KB mirror and one concave KB mirror is included, and also applicable to a case in which a plurality of pairs of a convex KB mirror and a concave KB mirror are used. The X-ray microscope according to the present invention only needs to include at least one pair of one convex KB mirror and one concave KB mirror, and may additionally include one or a plurality of pairs of a first concave KB mirror and a second concave KB mirror.

3.1. Concave KB Mirror

As described above, the X-ray microscope according to the present invention includes at least the concave KB mirror and the convex KB mirror. Among these KB mirrors, the concave KB mirror is disposed on a side closer to the sample holding part. The curvature of a reflection concave surface of the concave KB mirror and the curvature distribution thereof are not particularly limited, but the reflection concave surface may have, for example, an arc shape, an elliptical shape, a hyperbolic shape, or a parabolic shape. Among these shapes, it is preferable to have the elliptical shape to obtain a favorable imaging characteristic. The sample holding part is preferably disposed at the focal position of an elliptical mirror, in particular, the position of a focal position close to the sample holding part.

3.2. Convex KB Mirror

As described above, the X-ray microscope according to the present invention includes at least the concave KB mirror and the convex KB mirror, and the convex KB mirror is disposed on the side closer to the light receiving part. A sectional shape of a reflection convex surface is not particularly limited, but may be, for example, an arc shape, an elliptical shape, a hyperbolic shape, or a parabolic shape. Among these shapes, it is desirable to have the hyperbolic shape to obtain a favorable imaging characteristic. The reflection convex surface includes one curved line of a hyperbolic curve that is composed of the one curved line and the other curved line, and the light receiving part is preferably located at one of the focal positions of the hyperbolic curve, which is closer to the other curved line.

4. Light Receiving Part

The light receiving part in the present invention is a member configured to receive an imaged X-ray image through the convex KB mirror and the concave KB mirror of the X-ray microscope according to the present invention. The receiving member is typically an array sensor, and preferably a two-dimensional array sensor. Examples of the two-dimensional array sensor include a CCD element and a CMOS element. The pixel pitch of the array sensor is preferably 20 μm or less, more preferably 9 μm or less, further preferably 3 μm or less to clearly receive the imaged X-ray image.

The light receiving part may be a diffusion plate configured to convert a received X-ray into light having a wavelength longer than that of the X-ray, typically an ultraviolet ray or a visible light ray. Examples of the diffusion plate include a substrate containing a fluorescence material. X-ray imaging at the light receiving part can be acquired by imaging, through a visible light ray lens, light diffused through the diffusion plate and performing image capturing through an array sensor, preferably a two-dimensional array sensor such as a CCD element or a CMOS element.

Embodiment 1

The following describes an X-ray microscope in Embodiment 1 of the present invention.

FIG. 1 is a perspective view of an optical system of an X-ray microscope in Embodiment 1. In FIG. 1, an X-ray 2 emitted from an X-ray source 1 as the origin of the X-ray optical system is incident on a sample holding part 3 holding a sample as a microscopic observation target. The X-ray 2 (including light emission and scattering light) having transmitted through the sample holding part 3 is reflected at, in the following order, the reflection concave surface of a concave KB mirror 4, the reflection convex surface of a convex KB mirror 5, the reflection concave surface of a concave KB mirror 6 having a normal orthogonal to the normal of the concave KB mirror 4, and the reflection convex surface of a convex KB mirror 7 having a normal orthogonal to the normal of the convex KB mirror 5. The X-ray 2 then arrives at a light receiving part 8 located at a position in an imaging relation to the position of the sample holding part 3. In the example illustrated in FIG. 1, an elliptical focal position and a hyperbolic focal position coincide with each other. Thus, light emitted from the reflection concave surface of the concave KB mirror 4 all arrives at the hyperbolic focal position through a total of two times of reflection at the reflection concave surface and the reflection convex surface of the convex KB mirror 5. Accordingly, all optical paths have equal lengths, and thus the X-ray condenses without aberration. The condensing is also possible when the elliptical focal position and the hyperbolic focal position do not coincide with each other. The concave KB mirror 4 and the convex KB mirror 5 may be each any other concave or convex surface mirror such as a cylindrical surface mirror, but it is desirable that an elliptical concave surface mirror is used as the concave KB mirror 4 and a hyperbolic concave surface mirror is used as the convex KB mirror 5 as illustrated in FIG. 1 to reduce spherical aberration. A "condensing" condition and a "coma suppression" condition are needed for imaging of the X-ray 2 at the light receiving part 8, and the X-ray needs to be reflected an even number of times as illustrated in FIG. 1 to achieve coma suppression.

The concave KB mirror 4 has elliptical curvature in an X axis direction but no curvature in a Y axis direction, and accordingly has a function to condense an X-ray in the X axis direction. The convex KB mirror 5 has hyperbolic curvature in the X axis direction but no curvature in the Y axis direction, and accordingly has a function to change the progressing direction of an X-ray only in the X axis direction. The concave KB mirror 6 has elliptical curvature in the Y axis direction but no curvature in the X axis direction, and accordingly has a function to condense an X-ray in the Y axis direction. The convex KB mirror 7 has hyperbolic curvature in the Y axis direction but no curvature in the X axis direction, and accordingly has a function to change the progressing direction of an X-ray only in the Y axis direction. When a magnification in the X axis direction by the concave KB mirror 4 and the convex KB mirror 5 is equal to a magnification in the Y axis direction by the concave KB mirror 6 and the convex KB mirror 7, a sample image without distortion can be obtained on the light receiving part 8.

When the magnification in the X axis direction is not equal to the magnification in the Y axis direction, a sample image without distortion can be obtained by performing correction through expansion and contraction of a sample image obtained on the light receiving part 8 by an optical system of, for example, visible light or on electronic information, so that the magnification in the X axis direction is equal to the magnification in the Y axis direction.

FIG. 2 illustrates a geometric pattern diagram (upper part) of the X-ray optical system illustrated in FIG. 1, and illustrates, for reference, a visible light ray optical system (lower part) having a geometric optical function equivalent to an optical element used in the X-ray optical system. In the upper part of FIG. 2, to facilitate understanding, the concave KB mirror 6 and the convex KB mirror 7 for condensing in the Y axis direction are not illustrated. In the upper part of FIG. 2, the X-ray 2 emitted from the X-ray source 1 as the origin of the X-ray optical system is incident on the sample holding part 3 holding a sample as a microscopic observation target. The X-ray 2 having transmitted the sample holding part 3 is reflected at the reflection concave surface of the concave KB mirror 4 and the reflection convex surface of the convex KB mirror 5 in this order, and arrives at the light receiving part 8 located at a position in an imaging relation to the position of the sample holding part 3. An image of the sample can be determined by specifying the intensity distribution of the X-ray detected at the light receiving part 8.

The principal plane of a condenser optical system composed of the concave KB mirror 4 and the convex KB mirror 5 is located at a position illustrated with a dotted line in FIG. 2. There is a relation indicated by Expression (1) below among a distance (front-side focal distance) f between the sample holding part 3 and the principal plane, a distance (rear-side focal distance) L between the principal plane and the light receiving part 8, and a magnification Mag of the condenser optical system.

$$\text{Mag}=L/f \tag{1}$$

Expression (1) is used in description of an optical system reduction mechanism of the X-ray microscope according to the present invention in Embodiments 3 to 5 to be described later. The distance (L+f) between the position of the sample holding part 3 and the position of the light receiving part 8 is preferably 2.5 m or less. This distance is more preferably 2.0 m or less, and further preferably 1.8 m or less. To achieve this, the distance f desirably has a smaller value and is preferably 6 mm or more, more preferably 8 mm or more, further preferably 10 mm or more to have an appropriate working distance between the sample holding part 3 and the concave KB mirror 4. The value of f has an upper limit of, for example, 40 mm or less, more preferably 20 mm or less, and further preferably 16 mm or less.

Embodiment 2

FIG. 3 is a perspective view of the optical system of the X-ray microscope in Embodiment 2. The X-ray microscope in Embodiment 2 is different from the X-ray microscope in Embodiment 1 in that neither concave KB mirror 4 nor convex KB mirror 5 is provided in Embodiment 2. The other configuration is same as that of the X-ray microscope in Embodiment 1.

To evaluate an imaging characteristic of the X-ray microscope in Embodiment 2, a point spread function (PSF) that is distribution of an X-ray intensity at the light receiving part 8 is calculated under a condition that the X-ray source is an ideal point light source. FIG. 4 illustrates this point spread function. In FIG. 4, the horizontal axis represents a scale (centered at 500 nm) on the Y axis, and the vertical axis represents the X-ray intensity at the light receiving part 8. As illustrated in FIG. 4, a central peak has a half width (FWHM) of 38 nm, which indicates that a high space resolution is provided. Detailed conditions used in the calculation are as follows.

Mag: 181 times

L: 0.7 m f: 4.0 mm

NA of a lens system of the concave KB mirror 6 and the convex KB mirror 7: $1.3\times10^{-3}$

Embodiment 3

X-ray optical path simulation was performed, assuming an X-ray microscope in which the concave KB mirror 4 and the convex KB mirror 5 are not provided as in Embodiment 2. FIG. 5 illustrates an X-ray optical path up to a place separated by 120 mm from the sample holding part (zero point on the horizontal axis). The concave KB mirror 6 and the convex KB mirror 7 are disposed in this order halfway through the X-ray optical path.

Comparative Embodiment 1

FIG. 6 illustrates an X-ray optical path of an optical system in which two concave KB mirrors (a concave KB mirror 19 and a concave KB mirror 20) as in a conventional case are disposed, in place of the concave KB mirror 6 and the convex KB mirror 7, at positions same as the positions of the concave KB mirror 6 and the convex KB mirror 7 described in Embodiment 3 in the direction of the optical axis.

Embodiment 4

X-ray optical path simulation was performed, assuming an X-ray microscope in which the concave KB mirror 4 and the convex KB mirror 5 are not provided as in Embodiment 2. FIG. 7 illustrates an X-ray optical path up to a place separated by 120 mm from the sample holding part (zero point on the horizontal axis). The concave KB mirror 6 and the convex KB mirror 7 are disposed in this order at a position different from the example of Embodiment 3 and halfway through the X-ray optical path.

Comparative Embodiment 2

FIG. 8 illustrates an X-ray optical path of an optical system in which two concave KB mirrors (the concave KB mirror 19 and the concave KB mirror 20) as in a conventional case are disposed, in place of the concave KB mirror 6 and the convex KB mirror 7, at positions same as the positions of the concave KB mirror 6 and the convex KB mirror 7 described in Embodiment 4 in the direction of the optical axis.

Embodiment 5

X-ray optical path simulation was performed, assuming an X-ray microscope in which the concave KB mirror 4 and the convex KB mirror 5 are not provided as in Embodiment 2. FIG. 9 illustrates an X-ray optical path up to a place separated by 120 mm from the sample holding part (zero point on the horizontal axis). The concave KB mirror 6 and the convex KB mirror 7 are disposed in this order at a position different from the examples of Embodiments 3 and 4 and halfway through the X-ray optical path.

Comparative Embodiment 3

FIG. 10 illustrates an X-ray optical path of an optical system in which two concave KB mirrors (the concave KB mirror 19 and the concave KB mirror 20) as in a conventional case are disposed, in place of the concave KB mirror 6 and the convex KB mirror 7, at positions same as the positions of the concave KB mirror 6 and the convex KB mirror 7 described in Embodiment 5 in the direction of the optical axis.

Embodiment 6

FIG. 11 is a perspective view of an optical system of an X-ray microscope in Embodiment 6 of the present invention. The X-ray microscope in Embodiment 6 is different from the X-ray microscope in Embodiment 1 in that a first concave KB mirror 21 and a second concave KB mirror 22 are used for condensing in the X axis direction in Embodiment 6, whereas the concave KB mirror 4 and the convex KB mirror 5 are used for condensing in the X axis direction in Embodiment 1. The other configuration is same as that of the X-ray microscope in Embodiment 1.

The first concave KB mirror 21 and the second concave KB mirror 22 each have curvature in the X axis direction but no curvature in the Y axis direction, and accordingly has a function to condense an X-ray in the X axis direction.

The concave KB mirror 6 has curvature in the Y axis direction but no curvature in the X axis direction, and accordingly has a function to condense an X-ray in the Y axis direction. The convex KB mirror 7 has curvature in the Y axis direction but no curvature in the X axis direction, and accordingly has a function to change the progressing direction of an X-ray only in the Y axis direction.

The X-ray microscope described above in Embodiment 1 has a high effect of increasing the magnification for a sample, but the magnification is too high when a mirror has a large NA. In particular, a mirror (in Embodiment 1, the concave KB mirror 4 and the convex KB mirror 5 as a pair of mirrors for condensing in the X axis direction) close to a sample has a large NA, and thus the magnification is too high. In practical use, longitudinal and transverse (in the X axis direction and the Y axis direction) magnifications are desirably equal to each other. In the X-ray microscope in Embodiment 6, when a pair of mirrors (the first concave KB mirror 21 and the second concave KB mirror 22) on a side closer to a sample are both concave mirrors, an appropriate magnification can be obtained in the X axis direction so that the longitudinal and transverse magnifications of the X-ray microscope are adjusted to be equal to each other.

More preferably, it is desirable that the reflection concave surface of the first concave KB mirror 21 located at a place closer to the sample holding part than the second concave KB mirror 22 includes a hyperbolic curve, and the reflection concave surface of the second concave KB mirror 22 includes an ellipse. In the example illustrated in FIG. 11, the elliptical focal position of the second concave KB mirror 22 and the hyperbolic focal position of the first concave KB mirror 21 coincide with each other, and thus, similarly to Embodiment 1, X-rays emitted from a single point on a sample condense to a single point on an image plane. Thus, all optical paths from the sample to the image plane have equal lengths, and accordingly, a sharp image can be obtained.

FIG. 12 illustrates an X-ray optical path (X-axis projection) near the first concave KB mirror 21 and the second concave KB mirror 22 of the X-ray microscope in Embodiment 6. FIG. 13 illustrates an X-ray optical path (Y-axis projection) near the concave KB mirror 6 and the convex KB mirror 7 of the X-ray microscope in Embodiment 6. The X-ray microscope has condensing performance as listed in Table 1 below.

TABLE 1

| | | First concave KB mirror 21 | Second concave KB mirror 21 | Concave KB mirror 6 | Convex KB mirror 7 |
|---|---|---|---|---|---|
| Curve | Type | hyperbolic | elliptical | elliptical | hyperbolic |
| | Equation | $x^2/a^2 - y^2/b^2 = 1$ | $x^2/a^2 + y^2/b^2 = 1$ | $x^2/a^2 + y^2/b^2 = 1$ | $x^2/a^2 - y^2/b^2 = 1$ |
| | a | 0.095 m | 1.573 m | 0.0845 m | 1.479 m |
| | b | $4.075 \times 10^{-4}$ m | $5.619 \times 10^{-3}$ m | $1.254 \times 10^{-3}$ m | $1.853 \times 10^{-3}$ m |
| Prospective angle | | 16.86 mrad | 14.50 mrad | 15.68 mrad | 5.22 mrad |
| NA | | $5.057 \times 10^{-3}$ | | $5.043 \times 10^{-3}$ | |
| Focal distance f | | 21.47 mm | | 22.12 mm | |
| Magnification | | 144.6 times | | 140.4 times | |
| L + f | | 3127 mm | | | |

(Discussion)

In FIGS. 5 to 10, each position of the principal plane of the lens system is illustrated with a dotted line.

Comparison of FIG. 5 (Embodiment 3) and FIG. 6 (Comparative Embodiment 1) indicates that the position of the principal plane of a lens is separated from the sample holding part by 70 mm (refer to the value of f in FIG. 6) in Comparative Embodiment 1, but the position of the principal plane of a lens is separated from the sample holding part by 12 mm (refer to the value of fin FIG. 5) in Embodiment 3, which is an extremely reduced value. When the value of f is small, designing with a reduced value of L is possible on an assumption that the magnification Mag of the microscope is approximately maintained, as indicated by the above-described Expression (1). The value of L is 12.6 m in the example illustrated in FIG. 6, but the value of L is 2.0 m in the example illustrated in FIG. 5, which is an extremely reduced value. Thus, the X-ray microscope can be designed to be small enough to be brought into a laboratory.

Similarly, comparison of FIG. 7 (Embodiment 4) and FIG. 8 (Comparative Embodiment 2) indicates that the value of f is reduced from 22 mm to 4.0 mm and the position of the principal plane is located closer to the position of the sample holding part 3. Accordingly, the value of L is 3.8 m in the example illustrated in FIG. 8, but the value of L is 0.7 m in the example illustrated in FIG. 7, which is an extremely reduced value. Thus, the X-ray microscope can be designed to be small enough to be brought into a laboratory.

Similarly, comparison of FIG. 9 (Embodiment 5) and FIG. 10 (Comparative Embodiment 3) indicates that the value of f is reduced from 43 mm to 11 mm and the position of the principal plane is located closer to the position of the sample holding part 3. Accordingly, the value of L is 7.7 m in the example illustrated in FIG. 10, but the value of L is 2.0 m in the example illustrated in FIG. 9, which is an extremely reduced value. Thus, the X-ray microscope can be designed to be small enough to be brought into a laboratory.

The Embodiments 3 to 5 describe above effects of the present invention in an example with a one-dimensional condensing optical system. As described in Embodiment 1, a pair of a concave KB mirror and a convex KB mirror is used in each of the X axis direction and the Y axis direction to achieve two-dimensional condensing. For example, when both of the mirror system in Embodiment 3 (FIG. 5) and a mirror system obtained by rotating the mirror system in Embodiment 4 (FIG. 7) about the optical axis by 90° are used, a two-dimensional condenser optical system can be formed without interference between the mirrors. The rear-side focal distance (the value of L) of the mirror system in FIG. 5 is 2.0 m, and the rear-side focal distance (the value of L) of the mirror system in FIG. 7 is 0.7 m. These rear-side focal distances can be made equal to each other by adjusting, for example, the NA value and magnification of the mirror system in FIG. 7. In this adjustment, the magnification in the X direction and the magnification in the Y direction are different from each other in some cases, but distortion of the image plane can be optically or electrically corrected as described in the above-described embodiment. In any case, an extremely small X-ray microscope including a two-dimensional condenser optical system, the rear-side focal distance of which is 2.0 m, can be achieved.

The above-described Embodiment 6 is an X-ray microscope in which the concave KB mirror 6 and the convex KB mirror 7 are used for condensing in the Y axis direction, and the first concave KB mirror 21 and the second concave KB mirror 22 are used for condensing in the X axis direction. As understood from the above-described Table 1, since the first concave KB mirror 21 and the second concave KB mirror 22, which are located close to the position of the sample holding part 3, each has a concave reflection surface in the X-ray microscope according to the present embodiment, the position of the principal plane can be separated from a sample, and the magnification in the X axis direction can be reduced. Accordingly, a microscopic image, the magnification in the X axis direction and the magnification in the Y axis direction of which are close to each other, in other words, an aspect ratio of which is close to one can be obtained. The distance (L+f) between the position of the sample holding part 3 and the position of the light receiving part 8 is 3127 mm, which indicates downsizing of the entire device.

As described above, the principal plane needs to be separated from the position of the sample holding part 3 to obtain a certain magnification in a conventional X-ray microscope, but in the X-ray microscope according to the present invention, the position of the principal plane is located largely closer to the position of the sample holding part 3, and accordingly, an X-ray microscope with the value of L reduced enough to be brought into a laboratory can be provided.

INDUSTRIAL APPLICABILITY

The X-ray microscope according to the present invention can have a reduced rear-side focal distance of the optical system while the magnification is maintained. The present invention allows a conventional X-ray microscope not having a widely usable size, in other words, a size of which cannot be brought into a room, to have a widely usable small size, and has high industrial applicability by the use of an X-ray microscope in various scientific fields.

REFERENCE SIGNS LIST

1: an X-ray source
2: an X-ray
3: a sample holding part
4: a concave KB mirror

5: a convex KB mirror
6: a concave KB mirror
7: a convex KB mirror
8: a light receiving part
11: a visible light source
12: a visible light ray
13: a sample holding part
14: a visible light convex lens
15: a visible light concave lens
18: a light receiving part
19: a concave KB mirror
20: a concave KB mirror
21: a first concave KB mirror
22: a second concave KB mirror

The invention claimed is:

1. An X-ray microscope comprising:
an X-ray source;
a sample holding part;
a concave KB mirror which is a Kirkpatrick-Baez mirror having a reflection concave surface, and is a one-dimensional condensing mirror having curvature only in one direction;
a convex KB mirror which is a Kirkpatrick-Baez mirror having a reflection convex surface, and is a one-dimensional condensing mirror having curvature only in one direction; and
a light receiving part located at a position in an imaging relation to a position of the sample holding part in this order,
wherein the reflection concave surface of the concave KB mirror includes an elliptical curve.

2. The X-ray microscope according to claim 1, wherein
the sample holding part is located at a focal position of the elliptical curve.

3. The X-ray microscope according to claim 1, wherein:
the reflection convex surface of the convex KB mirror includes one curved line of a hyperbolic curve that is composed of the one curved line and another curved line; and
the light receiving part is located at a focal position of the other curved line side of focal positions of the hyperbolic curve.

4. The X-ray microscope according to claim 1, wherein
a distance between the concave KB mirror and the light receiving part is longer than a distance between the convex KB mirror and the light receiving part.

5. The X-ray microscope according to claim 1, wherein
a principal plane of an imaging system including the convex KB mirror and the concave KB mirror is located between the sample holding part and the concave KB mirror.

6. The X-ray microscope according to claim 1, wherein
a distance between the position of the sample holding part and the position of the light receiving part is 2.5 m or less.

7. The X-ray microscope according to claim 1, wherein:
the convex KB mirror is one of at least two convex KB mirrors;
the concave KB mirror is one of at least two concave KB mirrors;
a normal of a first of the at least two convex KB mirrors and a normal of a second of the at least two convex KB mirrors are nonparallel to each other; and
a normal of a first of the at least two concave KB mirrors and a normal of a second of the at least two concave KB mirrors are nonparallel to each other.

8. The X-ray microscope according to claim 1, wherein
a shortest distance between the sample holding part and the concave KB mirror is 6 mm or more.

9. The X-ray microscope according to claim 1, wherein
at least one of the convex KB mirror and the concave KB mirror is movable in an optical axis direction.

10. The X-ray microscope according to claim 1, wherein:
the concave KB mirror is a first concave KB mirror;
a second concave KB mirror and a third concave KB mirror are between the sample holding part and the first concave KB mirror;
a normal of the first concave KB mirror and a normal of the second concave KB mirror are nonparallel to each other; and
a normal of the convex KB mirror and a normal of the third concave KB mirror are nonparallel to each other.

11. The X-ray microscope according to claim 10, wherein:
the second concave KB mirror is closer to the sample holding part than the third concave KB mirror;
a reflection concave surface of the second concave KB mirror includes a hyperbolic curve; and
a reflection concave surface of the third concave KB mirror includes an elliptical curve.

12. The X-ray microscope according to claim 1, wherein
the X-ray source is configured to emit an X-ray having energy of 2 keV or higher.

13. The X-ray microscope according to claim 1, wherein
the concave KB mirror and the convex KB mirror are grazing incidence X-ray mirrors.

* * * * *